US008430704B2

(12) United States Patent
Jeffrey

(10) Patent No.: US 8,430,704 B2
(45) Date of Patent: Apr. 30, 2013

(54) FLOTATION DEVICE

(75) Inventor: Peter Jeffrey, Liverpool (GB)

(73) Assignee: Seatriever International Holdings Limited, Mobberley, Cheshire (GB)

( * ) Notice: Subject to any disclaimer, the term of this patent is extended or adjusted under 35 U.S.C. 154(b) by 650 days.

(21) Appl. No.: 12/223,376

(22) PCT Filed: Feb. 1, 2007

(86) PCT No.: PCT/GB2007/000315

§ 371 (c)(1),
(2), (4) Date: Apr. 21, 2010

(87) PCT Pub. No.: WO2007/088347

PCT Pub. Date: Aug. 9, 2007

(65) Prior Publication Data

US 2011/0104967 A1 May 5, 2011

(30) Foreign Application Priority Data

Feb. 2, 2006 (GB) ..... 0602087.9

(51) Int. Cl.
*B63B 45/00* (2006.01)

(52) U.S. Cl.
USPC ..... 441/17; 441/13; 441/16; 441/30

(58) Field of Classification Search ..... 441/13, 441/16, 17, 30, 31
See application file for complete search history.

(56) References Cited

U.S. PATENT DOCUMENTS

| | | | | |
|---|---|---|---|---|
| 2,619,303 | A | 11/1952 | Martin | |
| 2,821,725 | A | 2/1958 | Harper | |
| 2,994,892 | A | 8/1961 | Paradis | |
| 3,390,409 | A | 7/1968 | Mumane | |
| 4,511,069 | A * | 4/1985 | Kalat | 222/263 |
| 4,578,041 | A * | 3/1986 | Heitkamp et al. | 441/30 |
| 4,586,456 | A * | 5/1986 | Forward | 441/13 |
| 4,970,242 | A | 11/1990 | Lehman | |
| 5,199,374 | A | 4/1993 | Blanchette | |
| 5,210,525 | A | 5/1993 | Lennon | |
| 6,482,065 | B1 * | 11/2002 | Blackman | 446/220 |
| 7,261,606 | B2 * | 8/2007 | Mickelson et al. | 441/6 |
| 2004/0121672 | A1 | 6/2004 | McLarty | |

FOREIGN PATENT DOCUMENTS

| | | |
|---|---|---|
| DE | 35 18 062 | 11/1986 |
| DE | 37 02 448 | 8/1988 |
| DE | 200 20 776 | 2/2001 |
| FR | 2 733 482 | 10/1996 |
| GB | 2 406 265 | 3/2005 |
| JP | 51-025917 | 7/1976 |
| JP | 64-045599 | 3/1989 |

* cited by examiner

*Primary Examiner* — Lars A Olson
(74) *Attorney, Agent, or Firm* — Ladas & Parry LLP

(57) ABSTRACT

A device which will act efficiently as a float for any article (e.g. keys, mobile telephone, wallet) attached thereto when dropped into water comprises an inflatable bag (14) of substantially waterproof and air impervious material, a container (12) of compressed gas, and trigger means (16,30,32) associated with the container (12) and operable upon immersion of the device in water to open the container (12) and allow gas from the container (14) to inflate the bag (14). The trigger means comprises a valve (16) mounted on the container (12) and connecting the container to the inflatable bag (14), retainer means (30) operative to hold the valve (16) in a closed condition, and water reactive means (32) which, upon contact with water, serves to release the retainer means (30) and allow the valve to open. The water reactive means may comprise a band of material (32), at least part of which is water reactive.

21 Claims, 9 Drawing Sheets

Fig. 3
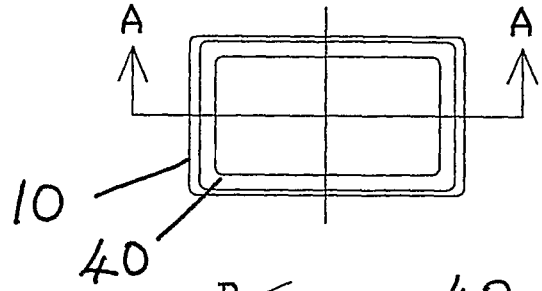
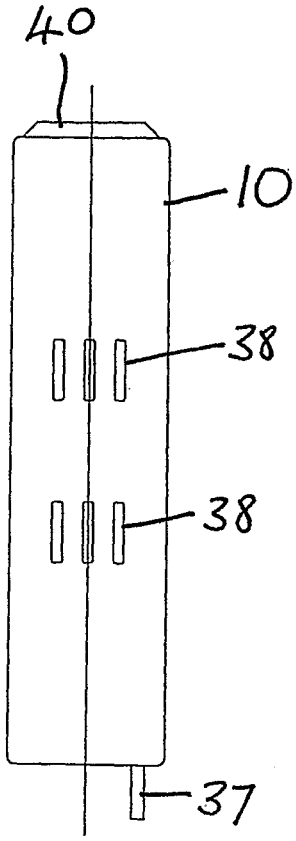
Fig. 1
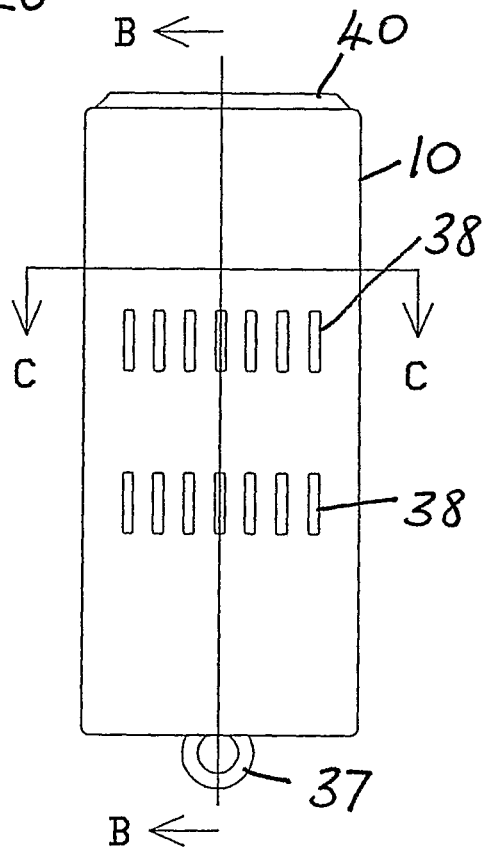
Fig. 2

FLOTATION DEVICE

This application is a 371 of PCT/GB2007/000315 filed on Feb. 1, 2007.

This invention concerns a device which is attachable to other articles, such as keys, wallets and mobile telephones, but not limited thereto, and which incorporates an automatically inflatable bag which will serve as a float for such articles if they are dropped into water, accidentally or otherwise. In this way retrieval of such articles is facilitated.

BACKGROUND

Cork devices have for many years been attached to items such as keys to enable them to float and be retrievable if dropped into water, for example in harbours and marinas. These cork devices are relatively bulky and are not sufficiently buoyant to support heavy items.

More recently, various proposals have been made, for example in FR 2733482, US 2004/0137810 and GB 2406265 A, for devices for this purpose which incorporate an automatically inflatable bag to serve as the float. These devices are all impractical to produce economically, or else are unsafe or unreliable in operation. For example, FR 2733482 proposes a cylinder in which acetylene gas is generated by a chemical reaction upon contact of calcium carbide with water. Even if this reaction was reliably achieved, it is clearly unsafe for use as acetylene is flammable. The proposal in US 2004/0137810 involves breakdown in water of a barrier between two compartments within the inflatable balloon, which would be most unreliable in practice. The proposal in GB 2406265 A and other known devices involve use of a canister of compressed carbon dioxide and a trigger device which involves piercing of a seal to this canister, the trigger device being dependent on breakdown of a material on contact with water. These are expensive to produce because a canister of compressed carbon dioxide must be of metal and sufficiently robust to withstand the high pressure required to contain the gas. Moreover, they are unreliable in use in part because of frequent occurrence of air locks in the passage of water to the water degradable material, but also because the force required to pierce such a seal is considerable and may not be achieved.

OBJECT OF THE INVENTION

An object of the invention is to provide a device of this general type which is more cost-effective to produce, and far more reliable in use than any of the known or previously proposed devices.

BRIEF SUMMARY OF THE DISCLOSURE

According the invention, a flotation device is proposed which comprises an inflatable bag of substantially waterproof and air impervious material, a container of compressed gas, trigger means associated with the container and operable upon immersion of the device in water to open the container and allow gas from the container to inflate the bag, a casing in which the bag, the container and the trigger means are housed, and means for attachment of the device to another article, but characterised in that the trigger means of such a device comprises a valve mounted on the container and connecting the container to the inflatable bag, retainer means operative to hold said valve in a closed condition, and water reactive means which, upon contact with water, serves to release the retainer means and allow the valve to open.

The operation of such a valve which is released in this way is highly reliable.

The valve may be spring biased into an open condition in some embodiments, but in other embodiments it may be spring biased into a closed condition. Various arrangements are proposed for release of the retainer means which hold the valve against the spring bias into an open condition in the first mentioned embodiments, or conversely which counter the spring bias into the closed condition in the second mentioned embodiments. In the latter, the spring itself comprises the retainer means.

In any arrangement, however, the water reactive means is preferably provided in the form of at least one water reactive band (strip) of material. A starch based polymer is a suitable material for such a band.

Advantageously, the container may be of plastics material and the compressed gas may suitably be a hydrogenated chlorofluorocarbon compound. This gas requires compression at far lower pressures than carbon dioxide, and can safely and suitably be contained in a low cost container of plastics material similar to the housing of a conventional inexpensive cigarette lighter. Moreover, it is safe to use and not an environmental hazard.

In order to prevent any possibility of an air lock developing in the passage of water into the device once it has been immersed, the casing preferably has a plurality of sidewalls and a plurality of elongated apertures are formed in at least two of these sidewalls. Additionally or alternatively the casing is provided with at least two separate rows of elongated apertures, at least one row being provided above the position of the water reactive means therein, and at least one row being provided below the position of the water reactive means therein.

In a further development of either aspect of the invention, an illumination device is advantageously mounted inside the inflatable bag. Such illumination device suitably comprises a light emitting diode (LED) powered by at least one battery, the latter being automatically connected to the LED upon inflation of the bag. This can be achieved by having a strip of insulating material initially located between the battery or batteries and the LED, said strip also being connected to the neck of the bag so that it is automatically withdrawn from extending between the battery or batteries and the LED upon inflation of the bag.

A further inventive development is the manner of attachment of such an illumination device inside the inflatable bag. This is suitably achieved by providing a projection on the illumination device whereby it is attached inside the inflatable bag, preferably at a location remote from the neck of the bag, by a clip or O-ring fitted over said projection from outside the bag. A further possibility is to provide the aforesaid clip or O-ring with an additional, preferably expansible, loop to facilitate retrieval of the device upon flotation.

Other advantageous developments will be apparent from the following description of specific embodiments of the device of the invention.

BRIEF DESCRIPTION OF THE DRAWINGS

The invention will be described further, by way of example, with reference to the accompanying drawings, in which:

FIG. 1 is a side view of a first practical embodiment of the device of the invention;

FIG. 2 is a front view of the same embodiment;

FIG. 3 is a top plan view of the same embodiment;

DETAILED DESCRIPTION

Figure 6:
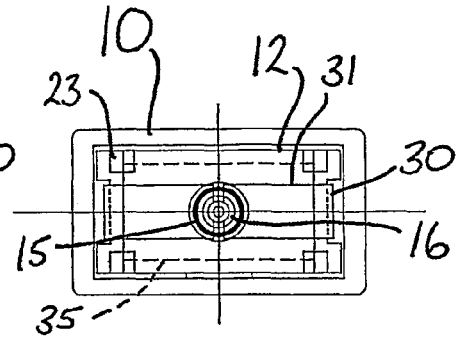
FIG. 6 is a cross-section along line C-C of FIG. 2 of the same device.

Referring firstly to FIGS. 1 to 7, a practical embodiment of the flotation device of the invention comprises a substantially rectangular casing 10 of plastics material which houses a gas container 12 and an inflatable bag 14, the container 12 being connected to the neck 15 of the bag 14 by way of a valve which is designated generally by reference numeral 16.

The inflatable bag 14 is of a substantially waterproof, water impervious, highly flexible and strong material, such as polyurethane film of the type used for modern condoms. The gas container 12 is made of plastics material, typically acetyl plastics, and is of a similar size and shape to the fuel tank of an inexpensive cigarette lighter. The gas inside is a hydrogenated chlorofluorocarbon which may be under a pressure of about 40 psi.

Figure 7:
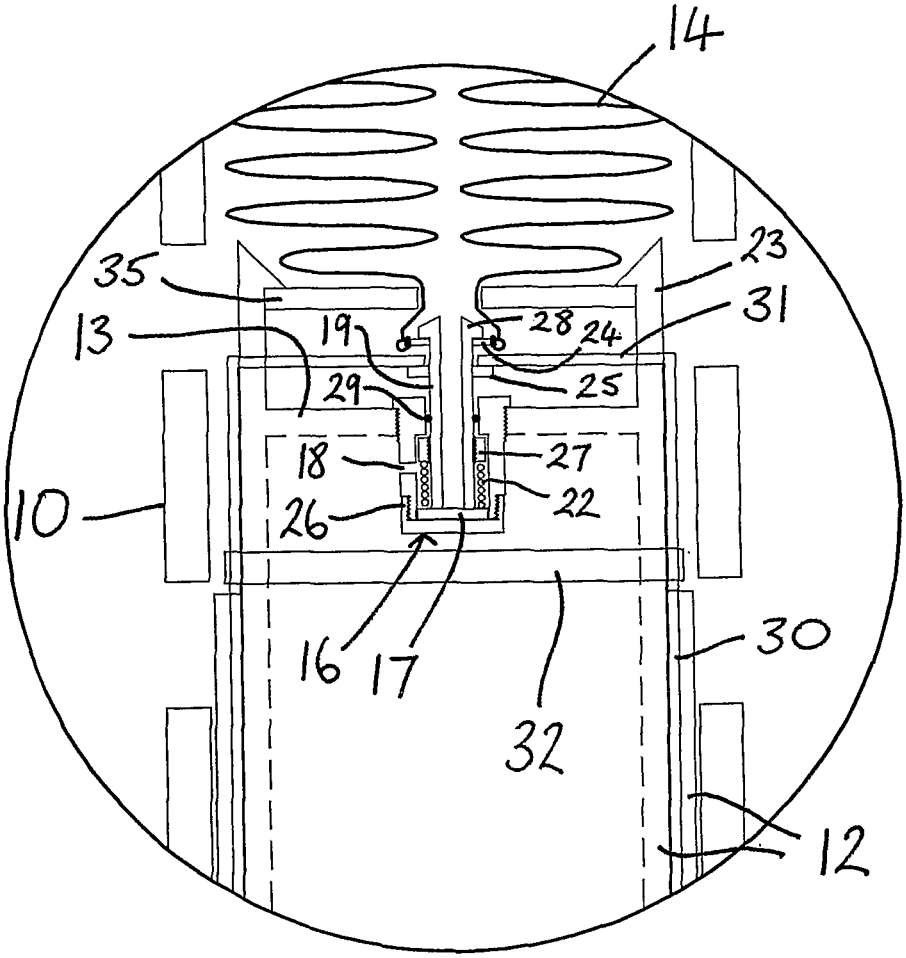
FIG. 7 is an enlarged detail of a central region of the device as shown in FIG. 5.

The container 12 fits into a lower region of the casing 10 and the bag 14 is folded into a small volume in an upper region of the casing 10. As best shown in FIG. 7 the valve 16 comprises a cup shaped body 26 mounted in a top wall 13 of the container 12. This body 26 defines a well, in the base of which a sealing plate 17 is mounted. It also has a side opening 18 communicating to the interior of the container 12. A tubular valve member 19 which is axially displaceable is located in the well of the body 26 with a sealing ring 29 there between. This tubular member 19 provides a conduit between the interior of the gas container 12 and the interior of the inflatable bag 14 as the neck 15 of the bag 14 is connected to a ring 24 which fits below a wedge profiled flange 28 at the top of the member 19. A helical spring 22 located around the tubular member 19 within the body 26 acts between the sealing plate 17 and a collar 27 on the tubular member to bias the tubular member 19 into a valve open condition where its bottom end is lifted from the sealing plate 17 (see FIGS. 8 and 9).

However, retainer means in the form of a U-shaped spring 30 and a band 32 serve to hold the tubular member 19 in a valve closed condition, against the bias of the spring 22, where the bottom end of the member 19 is pressed firmly against the sealing plate 17.

Figure 4:
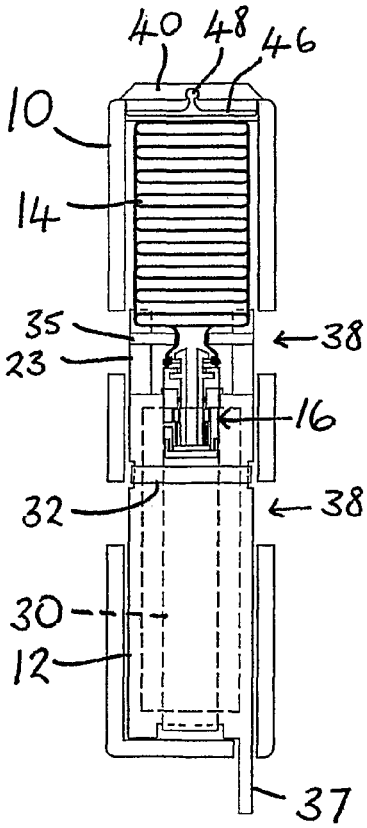
FIG. 4 is a cross-section along line B-B of FIG. 2 of the same device.
Figure 5:
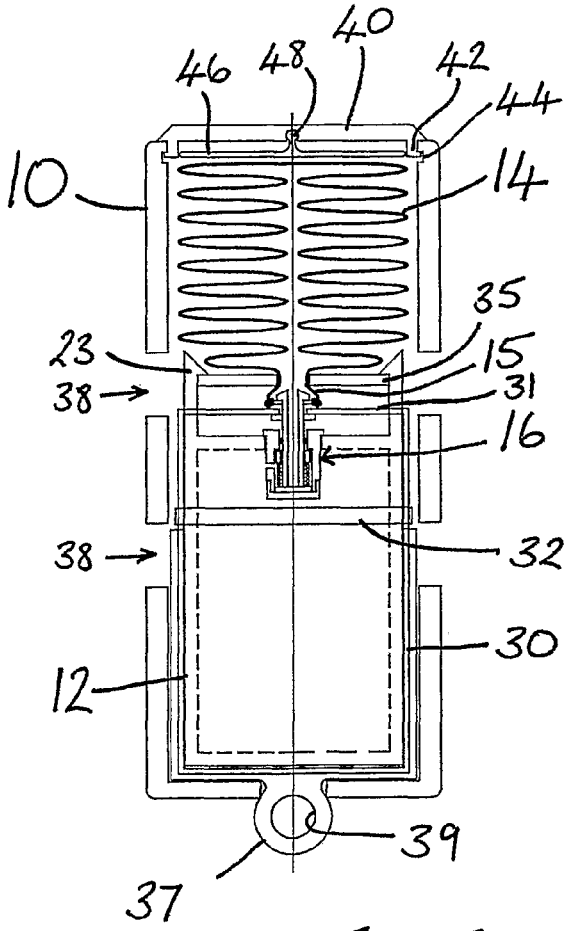
FIG. 5 is a cross-section along line A-A of FIG. 3 of the same device.

The U-shaped spring 30, as shown in FIGS. 4 and 5, extends around the base of the container 12. The side walls and base of the container 12 are recessed to accommodate and locate the limbs and central section of the U-shaped spring 30, as is evident in FIGS. 4 and 5. At its upper end the U-shaped spring 30 has opposing inwardly directed gripper arms 31 which fit behind a further intermediate flange or collar 25 on the tubular valve member 19 to hold it in its lower, closed condition as just explained. The U-shaped spring 30 is held under compression, against its natural tendency to spring open with the gripper arms 31 moving further apart, by the band 32 which encircles the container 12 and the respective limbs of the spring 30. This band 32 is water reactive in that it will disintegrate or rupture when immersed in water for a few moments. It may be made wholly or partially from a material, such as a starch based polymer, which softens and/or dissolves when immersed in either saltwater or freshwater. Alternatively, it may be made from a strip of material, such as polyurethane, which is not reactive to water, but which has its ends fastened together by a material, such as calcium carbonate, which rapidly dissolves in either saltwater or freshwater.

Pairs of catch projections 23 extend upwards beyond the top wall 13 at each side of the container 12 to retain a plate 35, which has a central aperture 36 through which the neck 15 of the bag 14 is inserted. This facilitates assembly during manufacture of the device and also facilitates reliable operation of the valve and inflation of the bag 14.

A circular tab 37 formed with an aperture 39 is provided as an integral extension from the base of the gas container 12 and extends through a corresponding opening in the casing 10. This enables attachment of the device by way of a key ring or similar articles, such as keys or purses or other items. Attachment of an article directly to the gas container 12 minimises any risk of its detachment from the deployed float once the device is immersed, as may be more likely to occur if its attachment is by way of the casing and the casing separates from the inflated bag and its connected gas supply container.

As shown in FIGS. 1 and 2, but also evident in FIGS. 4 and 5, the casing 10, which is also made of any suitable plastics material, is provided with two rows of elongated apertures 38 in each of its sidewalls, one such row being arranged above the level of the band 32 and one such row being arranged just below the level of the band 32. This ensures that upon immersion of the device in water, water quickly and reliably penetrates to the band 32 in order that it may be released as required, without the risk of air locks delaying water penetration, as has occurred in certain previous devices.

At the top, above the folded bag 14, the casing 10 is closed by an end cap 40. The end cap 40 has lugs 42 projecting from its inner surface adjacent each side edge, which lugs 42 are engageable as a snap fit into grooves 44 provided near the top of the corresponding opposing side walls of the casing 10. This allows the end cap 40 to be reliably retained on the casing 10 in normal circumstances when the bag 14 is not being deployed as a float, yet also allows ready release of the end cap 40 upon inflation of the bag 14 at the time of immersion of the device. However, to ensure such ready release, an additional inner plate 46 is provided between the bag 14 and the end cap 40. This inner plate 46 has a central projection 48 in the manner of the bead which fits into a corresponding central notch in the inner surface of the end cap 40. When the bag 14 is beginning to inflate, pressure is transmitted from the bag 14 to the inner plate 46 and is then concentrated at the central location of the bead 48 as it is transmitted to the end cap 40. This causes the end cap 40 to deform into a convex shape so that the respective lugs 42 at each side are simultaneously released and the end cap 40 as a whole along with the inner plate 46 quickly and reliably lifts off.

Figure 8:
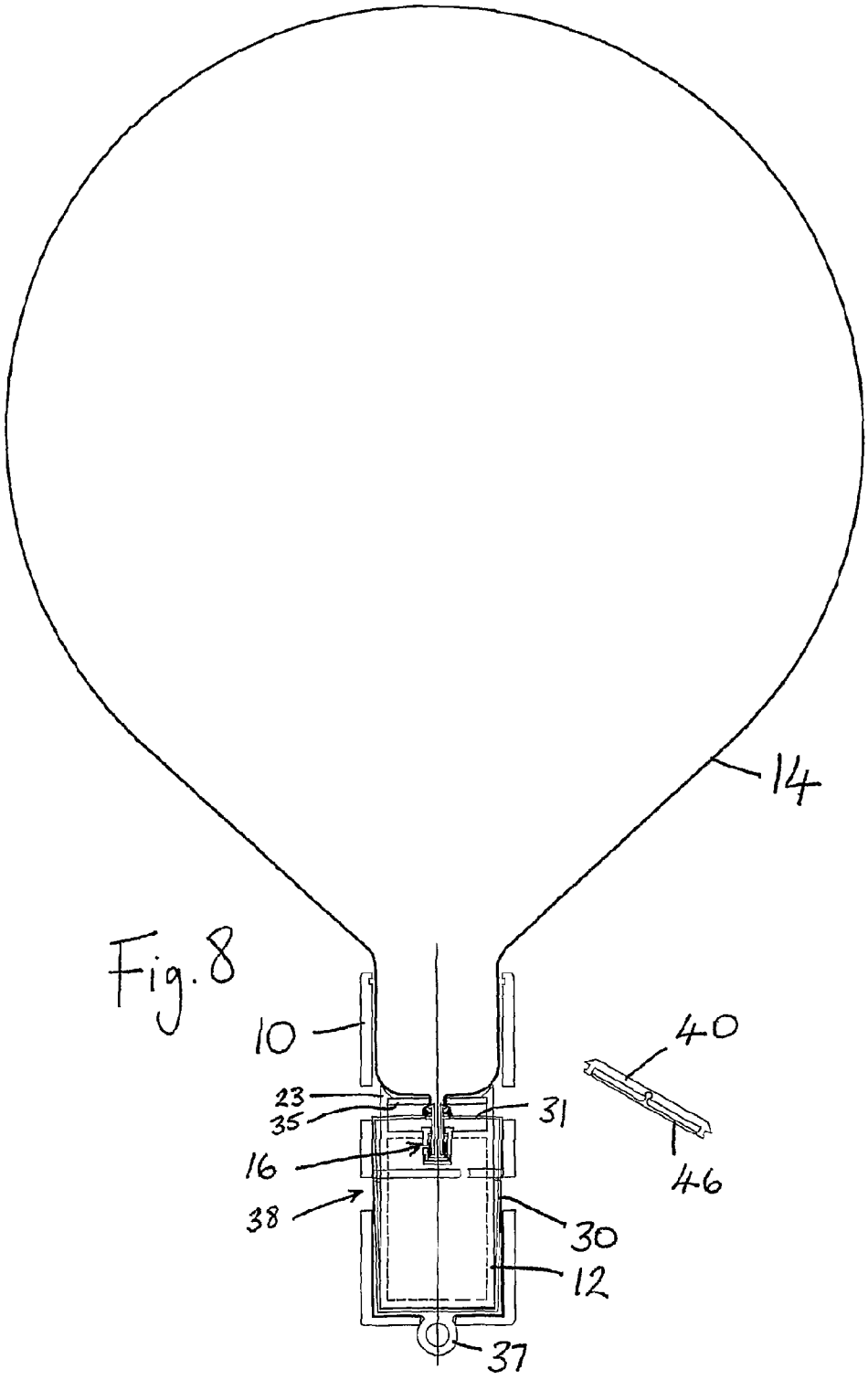
FIG. 8 is a reduced scale diagrammatic cross-section showing the device of FIGS. 1 to 7 once the bag has inflated.
Figure 9:
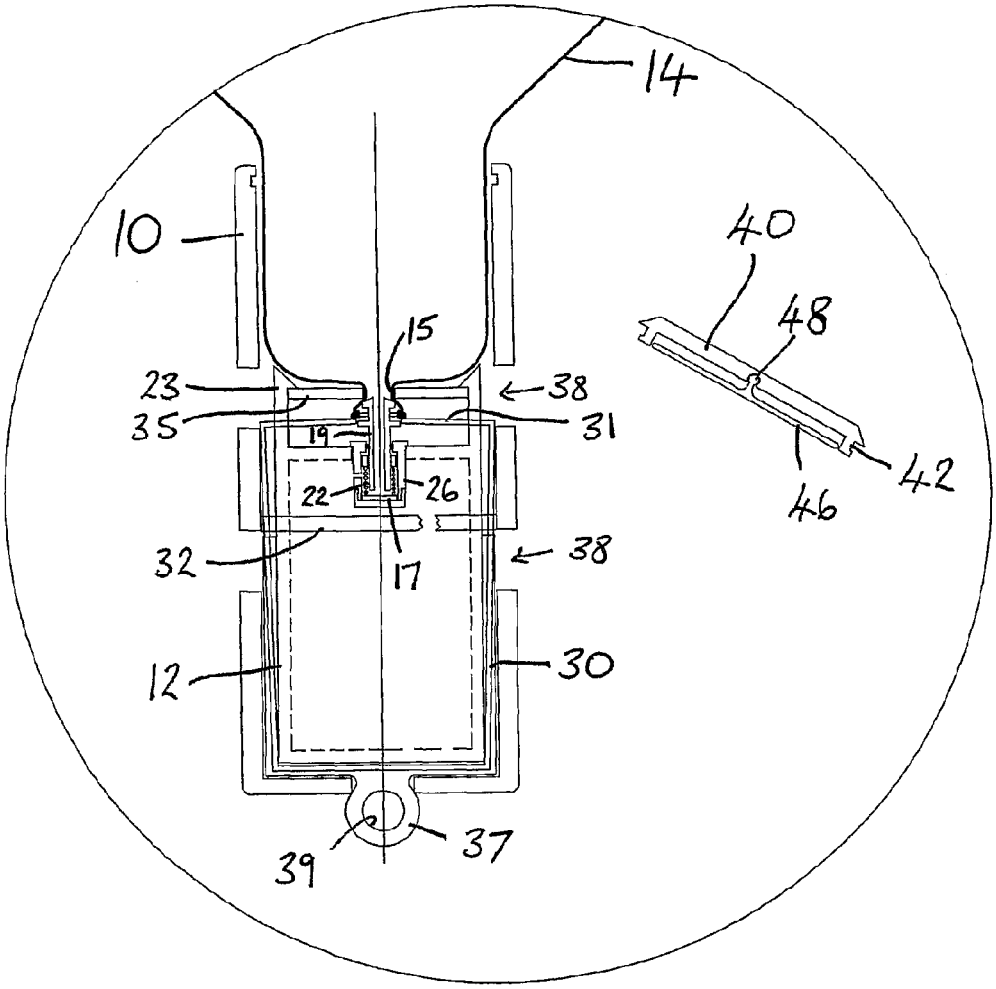
FIG. 9 is an enlarged detail of the casing region of the device in the inflated bag condition shown in FIG. 8.

The manner of operation of the above described device will now be readily apparent. When the device is dropped into water, water penetrates the casing 10 via the numerous apertures 38 and the band 32 ruptures, thus releasing the U-shaped spring 30 so that its gripper arms 31 move apart, away from the flange 25 on the tubular valve member 19. The tubular member 19 is therefore released and immediately urged upwards by the helical spring 22, thus opening the valve 16 and allowing gas to pass from the container 12 into the bag 14 to inflate it. The end cap 40 is pushed off the casing 10 in the manner just described above. The device with fully deployed float as provided by the inflated bag 14 is shown in FIG. 8.

From a small device which may have a total volume of about 20 cubic centimeters, including a container 12 having a capacity of only about 10 to 15 cubic centimeters of gas, an inflated bag having a capacity of at least 1.5 liter (and usually 1.75 to 2 liters) can be obtained. Such an inflated bag is capable of buoyantly supporting an article weighing up to about 1 kg while also leaving sufficient of the balloon above the water surface so as easily to be seen.

The foregoing is illustrative and not limitative of the scope of the invention and many variations in detail are possible in other embodiments.

In one particular modified embodiment, which in other respects is the same as that just described, the U-shaped spring may be of a different type which is held under tension and thereby normally tends to have its gripper arms urged towards each other so as to engage behind the collar 25 and hold the valve 16 in its lower, closed condition. The band 32 is replaced by a different band or by a pad or more than one pad mounted inwardly of the limbs of the U-shaped spring, between the limbs and the container 12, which band or pad(s) swell upon ingress of water to force the limbs and the gripper arms apart and release the valve 16 for inflation of the bag 14.

In other embodiments alternative or additional means of attachment of an article to the device may be provided in the form of one or more pads of high grab adhesive material mounted on the casing 10. In this way, multiples such devices may even be used as a buoyancy aid for heavier articles, such as laptop computers, which maybe carried on and off of boats. Several such devices would then be adhered at spaced locations to the article requiring buoyancy safety. It is believed that in this way articles up to 10 kg in weight could be supported by plural flotation devices of this type, or such heavier articles could be supported by one or more larger flotation devices in accordance with the invention.

In a related development, some embodiments of the invention may include an additional outer jacket mounted around the casing in order to provide the means of attachment of a pad or pads of adhesive material without masking or overlying the apertures in the casing which are necessary to ensure quick and reliable penetration of water, as needed for rapid inflation of the bag and deployment of the float. Thus, such an outer jacket may be securely clipped or latched onto the casing, but may extend only partially around the casing in order to leave accessible at least some rows of the apertures in the casing. Additionally or alternatively, spacer means may be disposed between the outer jacket and the casing to ensure that a gap is maintained for ingress of water to the casing and through the apertures in the casing.

Figure 10:
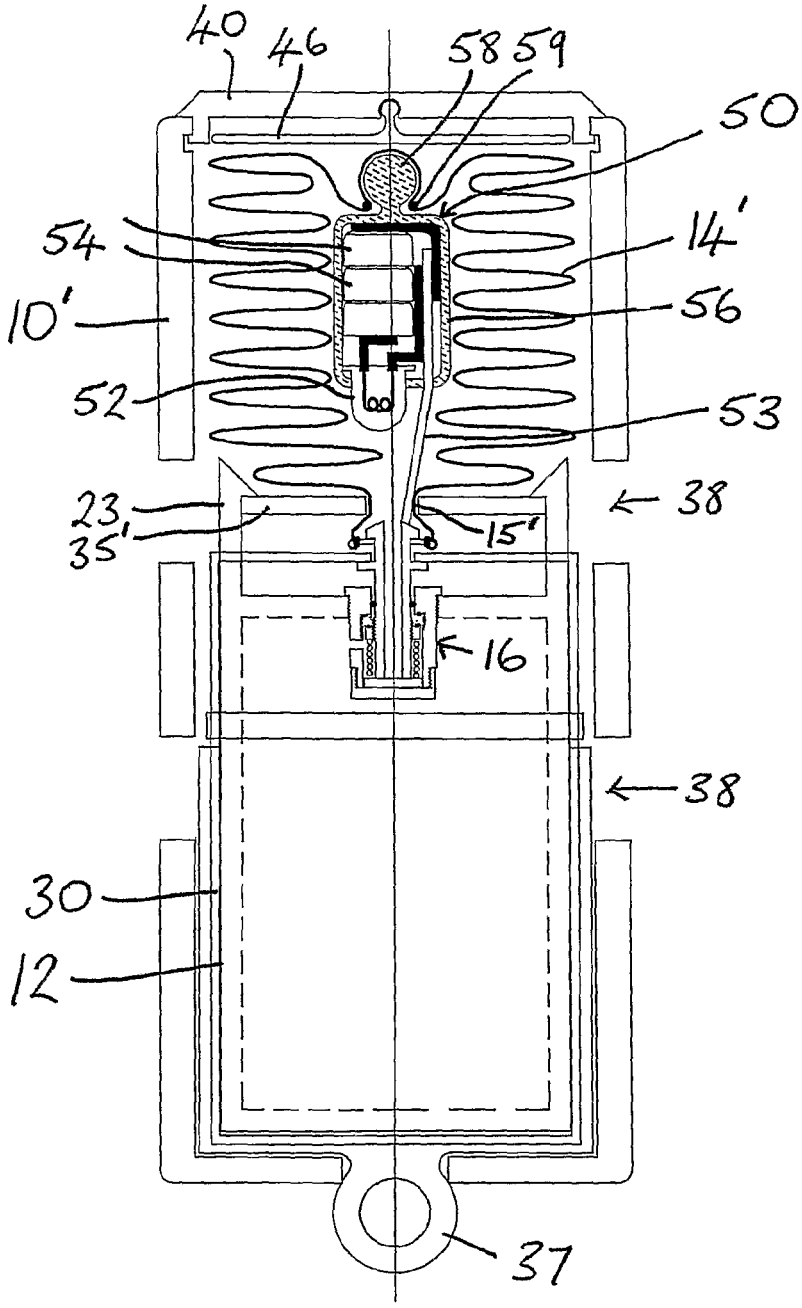
FIG. 10 is a view comparable to FIG. 5, but to a larger scale, of a second embodiment of the device of the invention.

FIG. 10 illustrates a particular modified form of the device in which an illumination device in the form of a small LED unit 50 is mounted inside the inflatable bag 14' in order to make the deployed float visible in the dark or poor light conditions. The unit 50 comprises a high-intensity LED 52 and three button cell batteries 54 mounted in a housing 56. The housing 56 is formed with a bead-like projection 58 which enables it to be attached inside the bag 14', preferably at a location remote from and opposite to the neck 15' through which gas enters upon inflation, by an O-ring 59 fitted over the bead 58 from the outside of the bag 14'.

In an advantageous modification which is not illustrated here, the O-ring, which is of elastomeric material, may be formed with an additional larger loop, which can be suitably folded and stowed into the casing 10' of the device in its initial condition. This larger loop will unfold automatically once the end cap 40' is released and will facilitate retrieval of the deployed flotation device by means of a boat hook or the like.

As regards the LED unit 50, a strip of insulating material 53 is provided which initially projects between contacts for the LED 52 and the batteries 54 in order to break the circuit. One end of this strip 53 is also trapped in the neck 15' of the bag 14' where it extends through the mounting plate 35'. Accordingly, as the bag 14' inflates the strip 53 is automatically withdrawn from between the contacts. The circuit between the batteries 54 and the LED 52 is completed and the latter lights up. Optionally, suitable circuit means may be included for intermittent illumination of the LED 52, thus greatly extending the possible battery life.

In all other respects the embodiment illustrated in FIG. 10 is the same as that in FIGS. 1 to 9 and the same reference numerals have been used to designate corresponding parts.

In a further modified embodiment a radio frequency transmitter could be mounted inside the inflatable bag in place of or as well as the LED unit.

Figure 11:
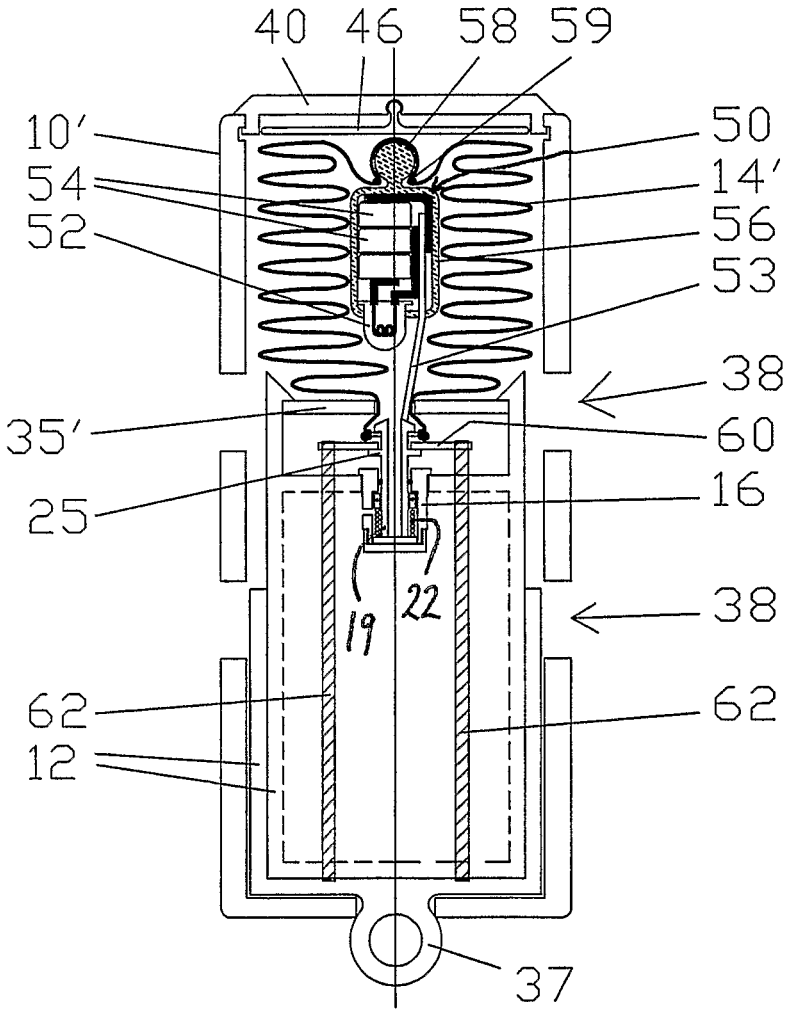
FIG. 11 is a cross section, similar to FIG. 10, of a third embodiment of the device of the invention.
Figure 12:
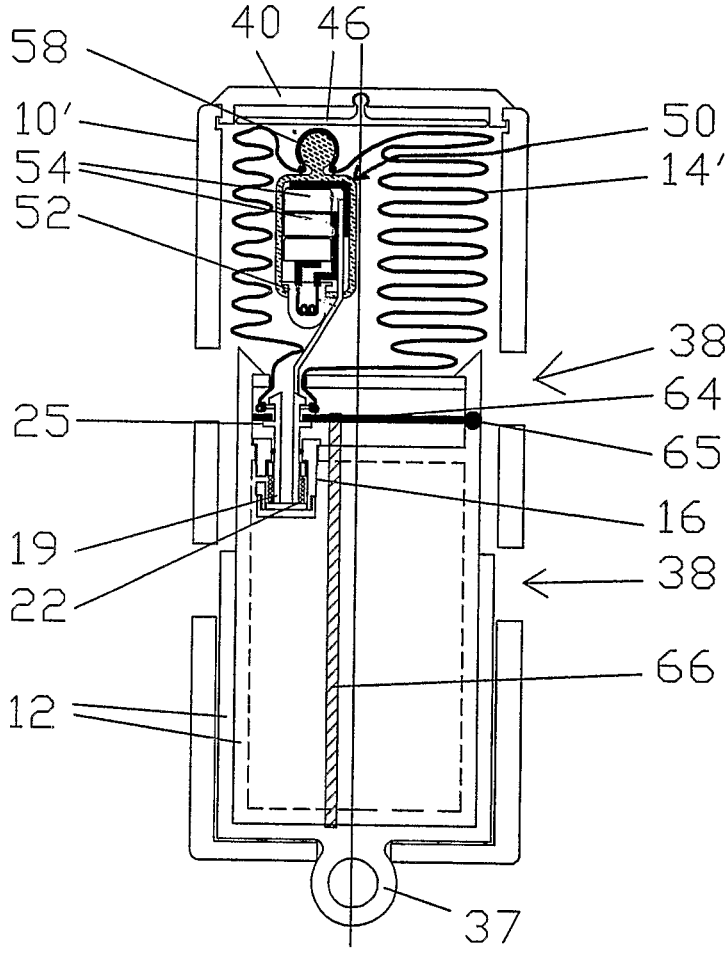
FIG. 12 is a cross section, similar to FIG. 10, of a fourth embodiment of the device of the invention.
Figure 13:
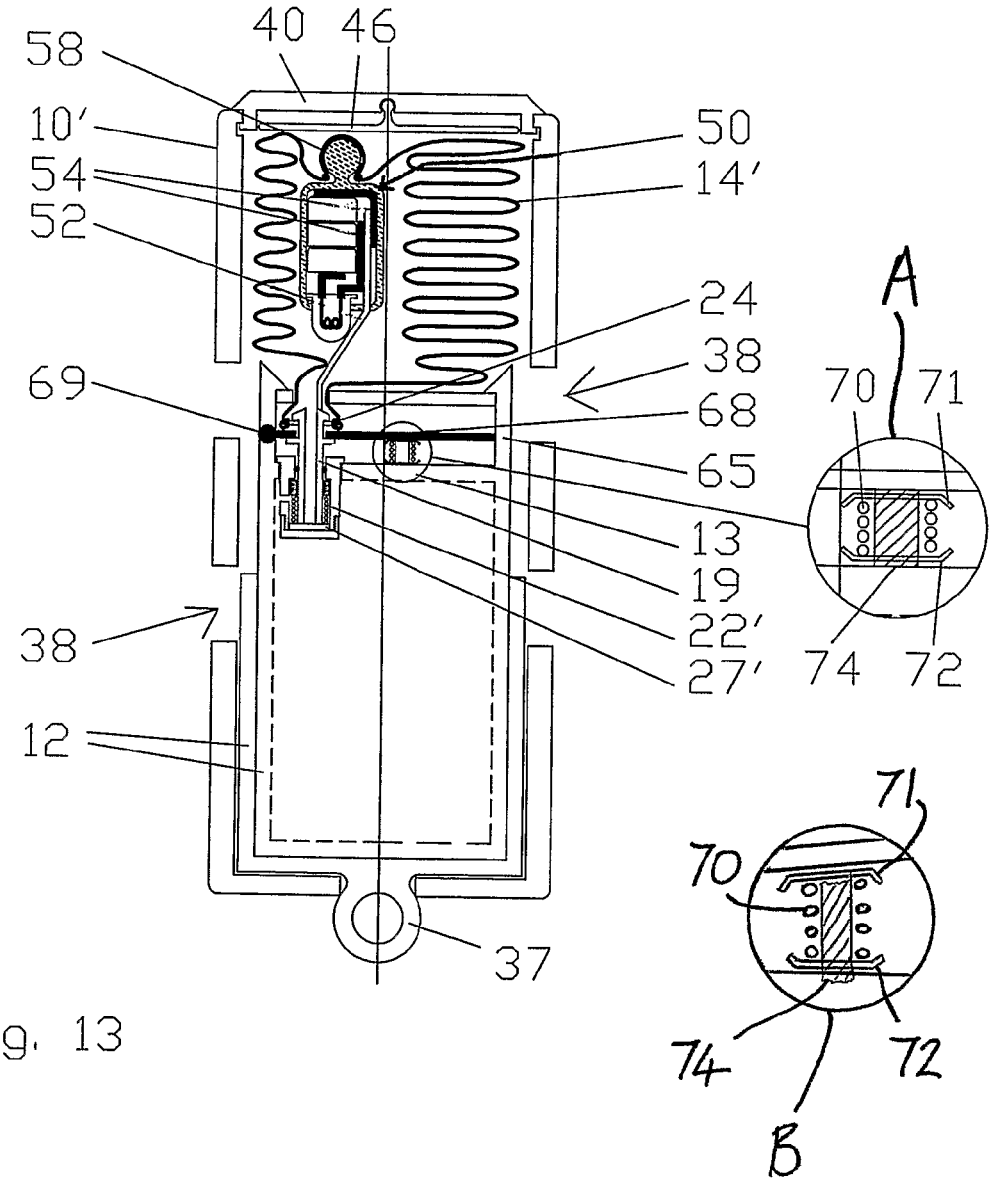
FIG. 13 is a cross section, similar to FIG. 10, of a fifth embodiment of the device of the invention.

FIGS. 11, 12 and 13 show three further embodiments, each of which has different retainer means for holding the valve 16 in a closed condition, and different means for release of same to allow the valve 16 to open compared to the preceding embodiments. However, all of these make use of at least one water reactive band of material to bring about release of the retainer means.

The embodiment shown in FIG. 11 has its tubular valve member 19 biased to an open position by the spring 22 as in the previous embodiments, but instead of being held by a U-shaped spring 30 this valve member 19 is held against spring bias by a plate 60, which itself is held in place by two water reactive bands 62 which extend around the container 12 from top to bottom. These bands 62 may be formed as previously described for the band 32 in the previous embodiments. This arrangement is simpler for assembly purposes during production compared to the previous embodiments, and avoids use of a special U-shaped spring, but it is equally effective in operation.

The embodiment shown in FIG. 12 also has its tubular valve member 19 biased to an open position by the spring 22 as in the previous embodiments. In this case the U-shaped spring 30 is replaced by a lever 64 which has one end swingably attached (at 65) to the wall of the container 12 and its other end engaging around the valve member 19 behind the flange or collar 25. The lever 64 is held down, against the bias of the spring 22 by a single water reactive band 66, which again extends around the container 12 from top to bottom. This is even simpler for assembly purposes than the FIG. 11 embodiment. To minimise the overall size of the device, the valve 16 is displaced to one side, with the band 66 being located near the centre.

An alternative possibility is for the lever 64 to be swingably attached to the container 12 at the other side compared to that shown in FIG. 12, namely close to the position of the valve 16, with the band 66 then holding the lever 64 down closer to its free end. In this respect, the valve member 19 needs only to be raised a very small distance to allow inflation of the bag 14.

In all other respects the embodiments of FIGS. 11 and 12 are the same as that of FIG. 10 and the same reference numerals have been used for corresponding parts.

The embodiment shown in FIG. 13 has a significantly different arrangement in contrast to all the previous embodiments, as its tubular valve member 19 is biased to a closed position. This is achieved by a spring $\mathbf{22}^1$ acting between the cup-shaped valve body 26 and a flange $\mathbf{27}^1$ near the end of the member 19. A lever 68 has one end swingably attached (at 69)

to the wall of the container 12 and its other end free. The valve 16 is displaced to one side, as in the FIG. 12 embodiment. In FIG. 13 the valve 16 is shown close to the lever attachment 69. The lever 68 engages the valve member 19 below the ring 24 which connects to the bag 14', or below any other suitably provided flange. As shown, a second helical spring 70 is mounted between the top wall 13 of the container 12 and the lever 68. As shown in the enlarged details A and B, this spring 70 is located between the upper and lower mounting plates 71, 72. In detail A it is shown held under compression by a water reactive band 74 which is wrapped around these plates 71, 72. As a unit, this compressed spring 70 wrapped by the band 74 is placed between the top wall 13 and the lever 68 upon assembly of the device. When the device is immersed in water the band 74 ruptures, as indicated in detail B, and the spring 70 urges the lever 68 upwards, overcoming the bias of the spring 22 to open the valve 16.

Again in all other respects the embodiment of FIG. 13 is the same as that of FIG. 10 and the same reference numerals have been used for corresponding parts.

The invention is not limited to the specific details of the foregoing embodiments, and other variations in constructional details are possible within the scope of the invention as defined in claim 1. In particular, it is envisaged that a significantly larger device may be produced, compared to the illustrated embodiments, with means of attachment to a larger article, such as a computer, and proportionately larger inflatable bag and larger gas supply for same so that a weight of up to or greater than 10 kg can be buoyantly supported by a single such device upon immersion in water.

Features described in conjunction with any particular aspect, embodiment or example of the invention are to be understood to be applicable to any other aspect, embodiment or example described herein unless incompatible therewith.

The invention claimed is:

1. A flotation device comprising an inflatable bag of substantially waterproof and air impervious material;

a container of compressed gas;

trigger means associated with the container and operable upon immersion of the device in water to open the container and allow gas from the container to inflate the bag;

a casing in which the bag, the container and the trigger means are housed; and means for attachment of the device to another article;

wherein the trigger means comprises a valve mounted on the container and connecting the container to the inflatable bag, retainer means operative to hold said valve in a closed condition, and water reactive means which, upon contact with water, serves to release the retainer means and open the valve;

wherein the water reactive means comprises a band of material, at least part of which is water reactive; and wherein the trigger means comprises a spring which is held under compression by the water reactive band and which is released, thereby to open the valve, when the band ruptures upon immersion of the device in water.

2. A flotation device according to claim 1 wherein the container is of plastics material and the compressed gas is a hydrogenated chlorofluorocarbon compound.

3. A flotation device according to claim 1 wherein the valve is spring biased into an open condition.

4. A flotation device according to claim 1 wherein the retainer means comprises a U-shaped spring extending around an end of the container remote from the valve and having opposed gripper arms which engage the valve.

5. A flotation device according to claim 4 wherein the water reactive means holds the U-shaped spring in position around the container with its arms engaging the valve.

6. A flotation device according to claim 1 wherein the retainer means comprises a lever.

7. A flotation device according to claim 5 wherein the band of material extends around the container and holds the lever against the action of the spring which biases the valve into an open condition.

8. A flotation device according to claim 7 wherein a lever is provided between the second spring and the valve.

9. A flotation device according to claim 1 wherein the retainer means comprises a spring which biases the valve into a closed condition.

10. A flotation device according to claim 9 wherein the band of material extends around a second spring to hold it under compression until released, said second spring being arranged to act, when released, to overcome the bias of the first spring and allow the valve to open.

11. A flotation device according to claim 1 wherein the water reactive means comprises a starch based polymer material.

12. A flotation device according to claim 1 wherein an illumination device is mounted inside the inflatable bag.

13. A flotation device according to claim 12 wherein the illumination device comprises a light emitting diode (LED) powered by at least one battery, the latter being automatically connected to the LED upon inflation of the bag.

14. A flotation device according to claim 13 wherein a strip of insulating material is initially located between the battery or batteries and the LED, said strip also being connected to the neck of the bag so that it is automatically withdrawn from extending between the battery or batteries and the LED upon inflation of the bag.

15. A flotation device according to claim 12 wherein the illumination device has a projection whereby it is attached inside the inflatable bag by a clip or O-ring fitted over said projection from outside the bag.

16. A flotation device according to claim 15 wherein said clip or O-ring is provided with an additional loop to facilitate retrieval of the device.

17. A flotation device according to claim 1 wherein the casing has a closure in the form of an end cap which overlies the inflatable bag and which is mounted on to the casing by inter-engaging formations so as to be releasable upon inflation of the bag.

18. A flotation device according to claim 17 including a release plate mounted between the inflatable bag and the end cap, the release plate being configured so as to apply pressure at a central location of the end cap.

19. A flotation device comprising:

an inflatable bag of substantially waterproof and air impervious material;

a container of compressed gas;

trigger means associated with the container and operable upon immersion of the device in water to open the container and allow gas from the container to inflate the bag;

a casing in which the bag, the container and the trigger means are housed; and means for attachment of the device to another article;

wherein the trigger means comprises a valve mounted on the container and connecting the container to the inflatable bag, retainer means operative to hold said valve in a closed condition, and water reactive means which, upon contact with water, serves to release the retainer means and allow the valve to open; and wherein an illumination device is mounted inside the inflatable bag, said illumination device comprising a housing, a light emitting diode (LED), and at least one battery to power the LED mounted in said housing, and said housing having a projection whereby it is attached to the inside of the inflatable bag by a clip or O-ring fitted over said projection from outside the bag.

20. A flotation device according to claim 19 wherein the battery is automatically connected to the LED upon inflation of the bag.

21. A flotation device comprising:

an inflatable bag of substantially waterproof and air impervious material;

a container of compressed gas;

trigger means associated with the container and operable upon immersion of the device in water to open the container and allow gas from the container to inflate the bag;

a casing in which the bag, the container and the trigger means are housed; and means for attachment of the device to another article;

wherein the trigger means comprises a valve mounted on the container and connecting the container to the inflatable bag, retainer means operative to hold said valve in a closed condition, and water reactive means which, upon contact with water, serves to release the retainer means and allow the valve to open;

wherein an illumination device is mounted inside the inflatable bag, said illumination device comprising a housing;

said illumination device also comprising a light emitting diode (LED) and at least one battery to power the LED mounted in said housing, and said housing having said illumination device comprising a housing having a projection whereby it is attached to an inside of the inflatable bag by a clip or O-ring fitted over said projection from outside the bag; and wherein a strip of insulating material is initially located between the battery or batteries and the LED, said strip also being connected to the neck of the bag so that it is automatically withdrawn from extending between the battery or batteries and the LED upon inflation of the bag.

* * * * *